US007997462B2

(12) United States Patent
Erb

(10) Patent No.: US 7,997,462 B2
(45) Date of Patent: Aug. 16, 2011

(54) BUNG HOLE AND TAP ASSEMBLY FOR SMALL CONTAINERS PROVIDED WITH AT LEAST ONE POSITIONING AND HOLDING MEANS

(75) Inventor: Rene Erb, Phalsbourg (FR)

(73) Assignee: Flextainer, Schalbach (FR)

( * ) Notice: Subject to any disclaimer, the term of this patent is extended or adjusted under 35 U.S.C. 154(b) by 503 days.

(21) Appl. No.: 11/631,142

(22) PCT Filed: Jun. 24, 2005

(86) PCT No.: PCT/FR2005/001606

§ 371 (c)(1),
(2), (4) Date: Oct. 9, 2007

(87) PCT Pub. No.: WO2006/013248

PCT Pub. Date: Feb. 9, 2006

(65) Prior Publication Data

US 2008/0135577 A1 Jun. 12, 2008

(30) Foreign Application Priority Data

Jul. 2, 2004 (FR) ..... 04 07384

(51) Int. Cl.
*B65D 35/56* (2006.01)

(52) U.S. Cl. ..... 222/567; 222/105; 222/570

(58) Field of Classification Search ..... 222/105, 222/400.7, 566, 567, 569, 570
See application file for complete search history.

(56) References Cited

U.S. PATENT DOCUMENTS

| | | | | |
|---|---|---|---|---|
| 3,397,824 | A * | 8/1968 | Ganung et al. | 222/570 |
| 4,380,310 | A | 4/1983 | Schneiter et al. | |
| 4,564,132 | A * | 1/1986 | Lloyd-Davies | 222/522 |
| 4,687,235 | A * | 8/1987 | Stoll | 285/281 |
| 5,022,560 | A * | 6/1991 | Campbell | 222/131 |
| 5,639,064 | A * | 6/1997 | deCler et al. | 251/149.5 |
| 6,446,845 | B1 * | 9/2002 | Steiger | 222/509 |
| 6,702,337 | B2 * | 3/2004 | Rutter et al. | 285/377 |
| 6,779,556 | B2 * | 8/2004 | Roethel | 137/614.03 |
| 6,892,760 | B2 * | 5/2005 | Roos et al. | 137/614.03 |
| 6,916,007 | B2 * | 7/2005 | deCler et al. | 251/149.6 |
| 6,953,070 | B1 * | 10/2005 | Labinski et al. | 141/351 |
| 7,487,951 | B2 * | 2/2009 | Johnson | 251/149.1 |
| 2003/0010387 | A1 * | 1/2003 | Rauworth et al. | 137/588 |
| 2003/0106610 | A1 * | 6/2003 | Roos et al. | 141/346 |

FOREIGN PATENT DOCUMENTS

| | | | |
|---|---|---|---|
| DE | 35 33 241 | C1 | 5/1987 |
| EP | 0 371 307 | A | 6/1990 |
| GB | 2 088 837 | A | 6/1982 |
| GB | 2 382 072 | A | 5/2003 |
| WO | WO 81/02418 | A | 9/1981 |

* cited by examiner

*Primary Examiner* — Kevin P Shaver
*Assistant Examiner* — Donnell Long
(74) *Attorney, Agent, or Firm* — The Watson I.P. Group, PLC; Javon N. Jovanovic; Vladan M. Vasiljevic

(57) ABSTRACT

The invention relates to a bung hole and tag assembly for small flexible containers, in particular for food liquids substantially consisting of a bung hole (2) of a container and a liquid dispensing tab comprising a body (1) for mounting in the bung hole (2) and dispensing a liquid. The inventive assembly is characterized in that it is provided with at least one means (3) for positioning and holding the bung hole (2) on the container and in a machine for producing containers or the similar and/or in a machine for filling and indexing the body (1) for mounting the tab in said bung hole (2). Said invention is particularly usable for producing small flexible containers, in particular for food liquids and for the dispensing tabs for said containers.

5 Claims, 1 Drawing Sheet

Figure 1:
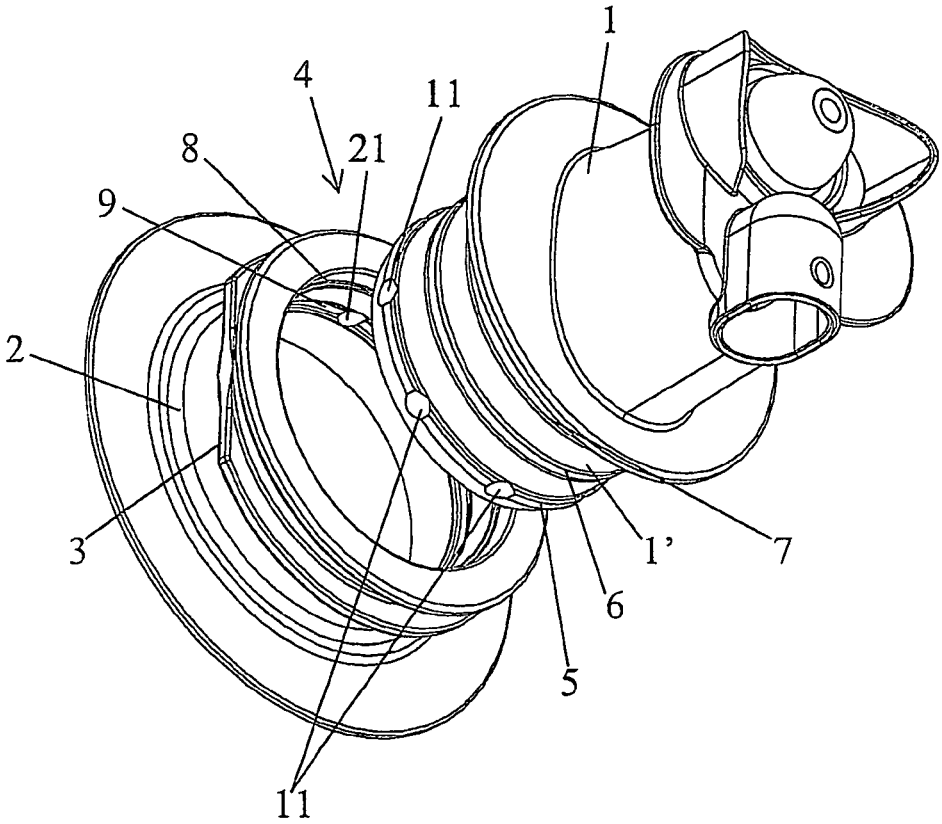

BUNG HOLE AND TAP ASSEMBLY FOR SMALL CONTAINERS PROVIDED WITH AT LEAST ONE POSITIONING AND HOLDING MEANS

The present invention relates to the field of the manufacture of small flexible containers, particularly for food liquids, and the dispensing taps equipping these containers, and its object is a bung hole and a tap assembly for such containers, which is provided with at least one positioning and holding means.

Currently, food drinks, particularly table wines, fruit juices and milk sterilized at ultrahigh temperature are generally dispensed from small flexible containers, such as containers which are made of synthetic material and known by the name "bag-in-box," by means of taps fixed to the withdrawal bung hole of these containers.

The taps that are currently marketed and used with containers of the "bag-in-box" type are independent closing and withdrawal devices manufactured separately from the mouth. These devices are prefitted or preassembled by an elastically tightening connection on the bung hole of the bag-in-box which is provided with a mouth. The packager, before filling the bag with liquid, clears the opening of the bung hole by elastically separating or disconnecting the withdrawal tap, and, after the filling operation, he inserts the latter definitively into the bung hole.

These known taps, which consist essentially of a body which is intended for mounting in the bung hole of a container and provided with a fixation shank which works in cooperation by locking with a bung hole and by a means of piston, which releases the liquid and is guided in said body, perfectly insure their temporary or definitive closing function.

However, these known taps, which are generally mounted temporarily in part in the bung hole of the corresponding bag-in-box, or container, when the containers are transported empty, and until their arrival on a packaging machine, have to be positioned in their definitive orientation after the filling of the bags-in-boxes, in view of their final use.

Indeed, when the tap is put in place definitively in the bung hole, it is nearly impossible to change its position, and it may be completely prevented from operating correctly. In addition, a poor initial positioning on a box-in-bag, before filling, can also be disadvantageous as it prevents the correct functioning, or even completely prevents the functioning, of the automatic removal or mounting of the tap in the packaging line.

Moreover, the bag-in-box also has to be oriented perfectly during the filling and placement phase of the tap, on the one hand, to guarantee a good guidance and proper hold on the filling machine, and, on the other hand, to allow the indexing of the tap during its assembly. The placement of the bung hole on the bag-in-box must thus be perfectly controllable to allow the indexing of the tap body.

The purpose of the present invention is to overcome the drawbacks of existing assemblies of this type by proposing a bung hole and tap assembly for small flexible containers, particularly for food liquids, which always ensures a correct arrangement on a flexible container of the bag-in-box type and a perfect positioning of the tap.

To this effect and according to the invention, the bung hole and tap assembly for small flexible containers, particularly for food liquids, which consists essentially of a bung hole on a container and of a dispensing tap for liquids comprising a body for mounting in the bung hole and a body for dispensing the liquid, is characterized in that it is provided with at least one positioning and holding means for the bung hole on the container and in a machine for producing containers or bags-in-boxes and/or in a machine for filling and indexing the body for mounting the tap in said bung hole.

Figure 2:
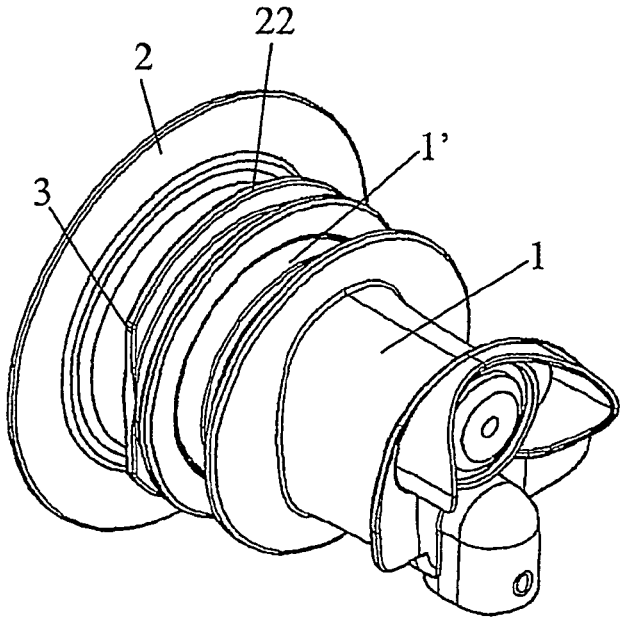

The invention will be better understood with the help of the following description which refers to a preferred embodiment, which is given as a nonlimiting example and explained in reference to the schematic drawing in the appendix, in which:

FIG. 1 is a perspective blow up view of an assembly according to the invention, and FIG. 2 is a perspective view of the tap body positioned and partially mounted in the bung hole.

FIGS. 1 and 2 of the drawing in the appendix represent a bung hole and tap assembly for small flexible containers, particularly for food liquids, which consists essentially of a bung hole 2 provided on a container (not shown) and of a tap for dispensing liquids, which comprises a body 1 for mounting in the bung hole 2 and for dispensing the liquid.

According to the invention, this assembly is provided with at least one means 3 for positioning and holding the bung hole 2 on the container or bag-in-box and in the machine for producing containers or bags-in-boxes and/or in the machine for filling and indexing the body 1 for mounting the tap in said bung hole 2.

The means 3 for positioning and holding the bung hole 2 on the container (not shown) and in the machine for producing containers or bags-in-boxes and/or in a machine for filling and indexing the body 1 for mounting the tap in said bung hole 2 consists essentially of at least one flat surface provided on an external ring 22 of the bung hole 2. Such an external ring 22 is generally intended for guiding and holding the bung hole while it is mounted on a bag-in-box, as well as for guiding the bag-in-box and bung hole assembly on a filling machine, notably before holding the bung hole at a constant distance from a filling means.

It is preferred for the means 3 to consist of two flat surfaces extending parallel to the external ring 22 of the bung hole 2.

The flat surface(s), which is formed by the means 3 of the external ring 22, ensure(s) a perfectly precise orientation of the bung hole on a bag-in-box, as it is placed on said bag-in-box by welding, and, then, guarantee the orientation of the bag in a guidance device of a filling machine. Indeed, during the manufacture of the bag, the bung hole 2 is guided on the manufacturing machine with a tap through the intermediary of guidance rails holding said bung hole, and then it is placed on the bag-in-box which is being formed and welded to it.

Thus, the means 3, which is formed by the flat surface(s), as a result of the cooperation of the latter with the guidance rails guarantees a constant positioning of the bung hole 2 and a placement of the latter with a constant orientation on the bag. The result is that, during the manufacture and the filling of the bag, the latter can be oriented perfectly throughout the entire operation and be held in position because the means 3 work in cooperation with a corresponding abutment device.

In addition, because the tap can be delivered to the machine for the formation of the bag-in-box while being partially mounted in the bung hole 2, as provided for in the patent FR 2 773 776, to reduce the manufacturing costs, the means 3, thanks to the orienting guidance of the bung hole 2, achieves a precise prior positioning of the mounting body of the tap 1. This positioning of the tap is carried out upstream of the mounting of the bung hole 2 on the bag-in-box or container, so that the transfer gripper, which transfers the assembly for the welding of the bung hole 2, can always grip and transfer said assembly. This prepositioning is also particularly advantageous in the filling operation; for example, with a machine as described in FR-A-2 848 202, the tap can then be removed entirely securely by means of a gripper having an appropriate shape, where the flat surface(s) constitute(s) the means 3 which guarantees a perfectly aligned presentation of the tap, because of the guidance carried out by said means 3.

The mounting of the tap in the bung hole 2 is carried out, in a known manner, by the cooperation of a shank 1' which can be engaged in the bung hole 2 where it can be locked, in the engagement position, through the intermediary of projections 5-7 and annular grooves 8, 9 which work in cooperation, in certain engagement positions, and which are provided on the shank 1' of the tap body 1 and in the bung hole 2, respectively.

According to an embodiment variant of the invention, the assembly of the bung hole 2 and the tap can be provided, in addition, with means 4 for positioning and holding the body 1 for mounting the tap in the bung hole 2, which is advantageously in the form of, on the one hand, at least one recess or point projection 11 provided on the shank 1' of the tap body 1, and, on the other hand, at least one projection or point recess 21 provided in the bung hole 2, where these recesses and projections work in mutual cooperation in at least one mounting position of the shank 1' of the tap 1 in the bung hole 2. Thus the recesses or point projections 11 provided on the shank 1' of the tap body 1 can work in cooperation, in at least one mounting position of the tap body 1 in the bung hole 2, with the projections or recesses 21 provided in the bung hole 2.

As shown in FIG. 1 of the drawing in the appendix, the shank 1' of the tap body 1 advantageously presents several recesses 11 arranged on at least one, 5, of its annular projections, and the bung hole 2 is provided with a corresponding projection 21 in at least one, 9, of its annular grooves. Thus, during a partial mounting of the tap body 1 in the bung hole 2, it is possible, by matching the recess(es) 11 of the shank 1' with the projection(s) 21 of the bung hole 2, to position the tap body 1 angularly with respect to the bung hole 2.

In the embodiment represented in the drawing in the appendix, the recesses 11 or the projection(s) 21 are provided on the projection 5 of the shank 1' and in the annular groove 9 of the bung hole 2, respectively. However, it is also conceivable to provide recesses 11 and projections 21 on the other annular projections 6 and 7 of the shank 1' and in the other annular groove 8 of the bung hole 2, respectively. The result is that in all the inserted positions of the tap body 1 in the bung hole 2, said tap body can always be oriented in a particularly precise and predetermined manner.

In the embodiment represented in the drawing in the appendix, the recesses 11, provided on the shank 1' of the tap body 1, are provided on the annular projection S extending close to the free end of said shank 1' and they work in cooperation with at least one projection 21 provided in the annular groove 9 close to the end of the bung hole 2 opposite the inlet end of the shank 1', that is close to the fixation of the shank on the container, such as, a bag-in-box.

FIG. 2 of the drawing in the appendix represents the provisional mounting of the tap body in the bung hole 2 in a position of cooperation of the means 4, in which the tap body 2 can be disconnected from the bung hole 2 through the intermediary of a gripping and tearing means of a filling machine.

During the reassembly by engagement of the shank 1' of the tap body 1 in the bung hole 2, said shank 1 is pushed completely into the bung hole 2, and it is locked in the operating position by the cooperation of the annular projections 6 and 7 of its shank 1' with the annular grooves 9 and 8 of the bung hole 2.

In an embodiment where all the annular projections of the shank 1' are provided with recesses and all the annular grooves of the bung hole are provided with corresponding projections, a permanent positioning of the tap body 1 can be ensured with respect to the bung hole 2 and the container which is provided with the latter.

In such an embodiment, the flat surface(s) forming the means 3, in cooperation with the means 4 for holding and positioning the tap body 1 in the bung hole 2, ensure(s) a precise indexing of said tap body 1 in said bung hole 2. This is particularly important when the tap is fixed temporarily in the bung hole 2 before the filling of the bag-in-box, to guarantee a precise orientation of said tap with respect to the gripping means of the filling machine whose purpose it to disconnect said tap, when the tap and bung hole assembly is not automatically set in a position by a special device during its transfer into the bag-in-box manufacturing machine, where this setting is carried out, for example, beforehand during a separate step.

In such a case, the flat surface forming the means 3 ensures a perfect orientation of the bung hole and the container, for example, on a filling machine, so that the tap, which is already positioned in the bung hole through the intermediary of the means 4, is perfectly oriented with respect to this gripping and disconnection means. Obviously, this advantage also exists if the tap and bung hole assembly is transferred to the bag-in-box or container for the positioning step prior to the welding of the bung hole.

Thanks to the invention, it is possible to produce a bung hole and tap assembly for small flexible containers, particularly for food liquids, which ensures this assembly with respect to the container with which it is provided, as well as with respect to a filling machine, as well as perfectly precise and permanent positioning and holding of the tap with respect to the bung hole.

Obviously, the invention is not limited to the embodiment which has been described and which is shown in the drawing of the appendix. Changes remain possible, notably from the point of view of the constitution of the various elements, or by replacement with technical equivalents, without exceeding the scope of protection of the invention.

The invention claimed is:

1. Bung hole and tap assembly for small flexible containers, in particular for food drinks, comprising: a bung hole (2) with a substantially planar bottom ring member having a bottom surface structurally configured to be welded onto a flexible bag forming a fluid tight seal and further provided with an external ring (22), the external ring which is disposed on the bung hole parallel to and spaced apart from the substantially planar bottom ring member and also spaced apart from a distal opening of the bung hole, is used for guiding and supporting the bung hole (2) and a tap for dispensing liquids inserted into the bung hole (2) and comprising an elongated tap body (1) for mounting of the tap into the bung hole (2) and for dispensing the liquid, wherein, on the bung hole (2), at least one means (3) is provided for positioning and holding the bung hole (2) on the container and in a machine for producing containers or wineskins and/or in a machine for filling and indexing the tap body (1) for mounting the tap in said bung hole (2) which means (3) comprises two flat surfaces extending in parallel on the external ring (22) of the bung hole (2) on the opposite side thereof designed to cooperate with a guiding means of a machine for producing and/or machine for filling.

2. Assembly according to claim 1, characterized in that it is provided, in addition, with a means (4) for positioning and holding the tap body (1) for mounting the tap in the bung hole (2), which means is in the form of, on the one hand, at least one recess or point projection (11) provided on a shank (1') of the tap body (1), and, on the other hand, at least one projection or point recess (21) provided in the bung hole (2), where these recesses and projections work in mutual cooperation in at least one mounting position of the shank (1') of the tap body (1) in the bung hole (2).

3. Assembly according to claim 2, characterized in that the shank (1') of the tap body (1) presents several recesses (11) arranged on at least one annular projection (5), and the bung hole (2) is provided with the corresponding projection (21) in at least one annular groove (9).

4. Assembly according to claim 2, characterized in that recesses (11) and projections (21) are provided on several annular projections (6 and 7) of the shank (1') and in several annular grooves (8 and 9) of the bung hole (2), respectively.

5. Assembly according to claim 1, characterized in that the external ring (22) is integrally formed with the bung hole (2) so as to be molded from a single piece of material.

* * * * *